US005107639A

United States Patent [19]

Morin et al.

[11] Patent Number: 5,107,639

[45] Date of Patent: Apr. 28, 1992

[54] PORTABLE AND COLLAPSIBLE BUILDING STRUCTURE

[75] Inventors: J. Cecil Morin, Winterburn, Canada; James A. Loggie, Box 1341 Strathmore, Alberta, Canada, T0J 3H0

[73] Assignees: Kenneth Van Wezel; James A. Loggie, both of Canada

[21] Appl. No.: 563,944

[22] Filed: Aug. 7, 1990

Related U.S. Application Data

[63] Continuation of Ser. No. 445,168, Dec. 12, 1989, abandoned, which is a continuation of Ser. No. 303,243, Jan. 30, 1989, abandoned.

[51] Int. Cl.[5] ..... B65D 7/26

[52] U.S. Cl. ..... 52/71; 220/6

[58] Field of Search ..... 52/71, 79.5; 220/1.5, 220/6, 7, 4.28, 334

[56] References Cited

U.S. PATENT DOCUMENTS

| | | | |
|---|---|---|---|
| 617,043 | 1/1899 | Phifer . | |
| 1,062,976 | 5/1913 | Jackson . | |
| 1,149,213 | 8/1915 | Neuberth . | |
| 1,469,525 | 10/1923 | Nadolney . | |
| 1,481,142 | 1/1924 | Minton et al. . | |
| 2,207,836 | 7/1940 | Sundell | 16/254 |
| 2,591,984 | 4/1952 | Walsh | 16/137 |
| 2,803,084 | 8/1957 | Frerking | 220/6 X |
| 3,040,925 | 6/1962 | Mills | 220/4.28 |
| 3,189,949 | 6/1965 | Hurkamp | 52/71 |
| 3,288,516 | 11/1966 | Lewis | 52/71 |
| 3,341,987 | 9/1967 | Johansson | 52/70 |
| 3,434,253 | 3/1969 | Hatcher | 52/69 |
| 3,452,501 | 7/1969 | Zimmer et al. | 52/823 |
| 3,562,973 | 2/1971 | Gangemi | 52/71 |
| 3,566,554 | 3/1971 | Schaffer et al. | 52/64 |
| 3,752,349 | 8/1973 | Rana | 220/6 |
| 3,781,944 | 1/1974 | Gianardi | 16/187 |
| 3,886,676 | 6/1975 | Alfonso | 52/584 |
| 3,982,650 | 9/1976 | Ichihara | 220/4.28 |
| 3,984,949 | 10/1976 | Wahlquist | 52/70 |
| 4,035,964 | 7/1977 | Robinson | 52/66 |
| 4,166,343 | 9/1979 | O'Brian et al. | 52/66 |
| 4,439,969 | 4/1984 | Bartlett | 52/466 |
| 4,544,300 | 10/1985 | Lew et al. | 403/170 |
| 4,577,772 | 3/1986 | Bigliardi | 220/1.5 |
| 4,641,475 | 2/1987 | Berridge | 52/584 |
| 4,641,985 | 2/1987 | Bard et al. | 403/16 |
| 4,649,684 | 3/1987 | Petree et al. | 52/395 |
| 4,652,170 | 3/1987 | Lew | 403/331 |
| 4,684,034 | 8/1987 | Ono et al. | 220/1.5 |
| 4,696,132 | 9/1987 | Le Blanc | 52/69 |
| 4,726,155 | 2/1988 | Nahmias | 52/71 |
| 4,742,653 | 10/1988 | Napier et al. | 52/66 |

FOREIGN PATENT DOCUMENTS

| | | | |
|---|---|---|---|
| 2454985 | 5/1975 | Fed. Rep. of Germany | 52/71 |

*Primary Examiner*—David A. Scherbel
*Assistant Examiner*—Michele A. Van Patten
*Attorney, Agent, or Firm*—Roylance, Abrams, Berdo & Goodman

[57] ABSTRACT

A portable and collapsible building structure including a floor, a pair of side walls, a roof and a pair of end walls. The side walls each include a lower and upper panel pivotally coupled at their inner edges by a first hinge assembly. The outer edges of the side walls are pivotally coupled to the floor and roof by a second hinge assembly. The end walls are pivotally coupled to the roof by a third hinge assembly and releasably coupled to the floor and side walls by a C-shaped coupling chip. The first, second and third hinge assemblies permit the building structure to collapse so that the upper and lower panels of each side wall lie substantially flat between the floor and the roof, while the end walls pivot 270° so as to lie substantially flat upon the roof. The first, second and third hinge assemblies include a plurality of one-piece, extruded, coupling channels, a plurality of hinge inserts, at least one hinge pin, and a C-shaped coupling clip.

21 Claims, 6 Drawing Sheets

PORTABLE AND COLLAPSIBLE BUILDING STRUCTURE

This is a continuation of application Ser. No. 07/445,168 filed Dec. 12, 1989, now abandoned, which is a continuation of application Ser. No. 07/303,243, filed Jan. 30, 1989, now abandoned.

FIELD OF THE INVENTION

This invention relates to a building structure which is portable and collapsible. The building structure is lightweight and collapsible to a compact shipping and transporting position. This is accomplished by a plurality of hinge assemblies that permit the side and end walls, roof and floor to lie flat upon one another to minimize the size of the building structure in its collapsed position.

BACKGROUND OF THE INVENTION

The increasing world population (now five billion) has led to housing shortages worldwide. These shortages are also increasing due to the number of people left homeless from natural disasters. Accordingly, there is a need for low cost housing that may be easily transported and assembled where needed, and later disassembled and moved.

While many attempts have been made to provide portable building structures, these structures suffer from numerous disadvantages. Many of these structures are heavy, complex and costly to make, and difficult to assemble and disassemble. In addition, many of these building structures require constant maintenance; for example, wooden structures tend to splinter and constantly need to be waterproofed. Moreover, these building structures tend to corrode due to air pollutants and rust, rot or mildew due to adverse weather conditions. Also, many of the prior art devices require special tools for assembly and disassembly.

Examples of these prior building structures are disclosed in the following U.S. Pat. Nos.: 617,043 to Phifer; 1,062,976 to Jackson; 1,149,213 to Neuberth; 1,469,525 to Nadolney; 1,481,142 to Minton et al; 2,207,836 to Sundell; 2,591,984 to Walsh; 3,189,949 to Hurkamp; 3,341,987 to Johansson; 3,434,253 to Hatcher; 3,452,501 to Zimmer et al; 3,562,973 to Gangemi; 3,566,554 to Schaffer et al; 3,781,944 to Gianardi; 3,984,949 to Wahlquist; 3,886,676 to Alfonso; 4,035,964 to Robinson; 4,166,343 to O'Brian et al; 4,439,969 to Bartlett; 4,544,300 to Lew et al; 4,641,475 to Berridge; 4,641,985 to Bard et al; 4,649,684 to Petree et al; 4,652,170 to Lew; 4,696,132 to LeBlanc; 4,726,155 to Nahmias; and 4,742,653 to Napier et al.

This invention addresses these needs discussed above in the art, along with other needs which will become apparent to those skilled in the art once given this disclosure.

SUMMARY OF THE INVENTION

Accordingly, a primary object of the present invention is to provide a building structure which is readily and easily assembled and disassembled without the need of any tools.

Another object of the present invention is to provide a building structure that is portable.

Still another object of the present invention is to provide a building structure that is lightweight and very strong.

Yet another object of the present invention is to provide a collapsible building structure that is very compact so that it can be easily transported.

Yet another object of the present invention is to provide a building structure that has very low maintenance.

Yet another object of the present invention is to provide a building structure that will not rust, rot or mildew and is highly resistant to most weather conditions.

Yet another object of the present invention is to provide a building structure that is relatively inexpensive to manufacture and uses a series of extruded channels to form the required hinges.

Yet another object of the present invention is to provide hinge assemblies that require relatively no assembly.

The foregoing objects are basically attained by a portable and collapsible building structure, comprising: a first pair of opposed walls; a second pair of opposed walls, each of the second pair of walls including first and second panels pivotally coupled together by first hinge assemblies, each of the second pair of walls being pivotally coupled to each of the first pair of walls by second hinge assemblies, whereby the second pair of walls may be collapsed inwardly from erect positions to collapsed positions such that each of the first panels overlies one of the second panels; a third pair of opposed walls, each of the third pair of walls being pivotally coupled to one of the first pair of walls by third hinge assemblies such that the third hinge assemblies permit each of the third pair of walls to pivot about 270° between collapsed positions and erect positions; and coupling members, coupled to the first, second and third pairs of walls for retaining the first, second and third pairs of walls in their erect positions.

Also, the foregoing objects can be attained by a portable and collapsible building structure, comprising: a first pair of opposed walls; a second pair of opposed walls, each of the second pair of walls including first and second panels pivotally coupled together by first hinge assemblies, the second pair of walls being pivotally coupled to the first pair of walls by second hinge assemblies, the first and second hinge assemblies being pivotable such that the first walls may be moved between collapsed positions and erect positions; a third pair of opposed walls, each of the third pair of walls being pivotally coupled to one of the first pair of walls by third hinge assemblies, the third hinge assemblies, each including a header having a first hinge member, a second hinge member spaced apart from the first hinge member, the first hinge member pivotally coupling the header to one of the first pair of walls and the second hinge member pivotally coupling the header to one of the third pair of walls, and coupling members, coupled to the first, second and third pairs of walls for retaining the first, second and third pairs of walls in their erect positions.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form part of this original disclosure.

DETAILED DESCRIPTION OF THE INVENTION

Figure 1:
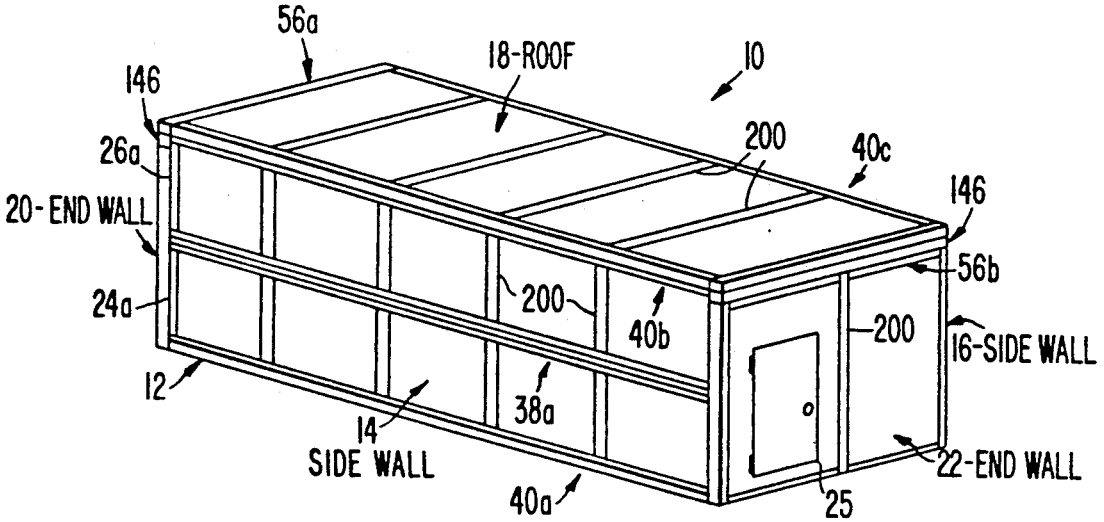
FIG. 1 is a left perspective view of a building structure in accordance with the present invention in its erect position with hinge details omitted.
Figure 2:
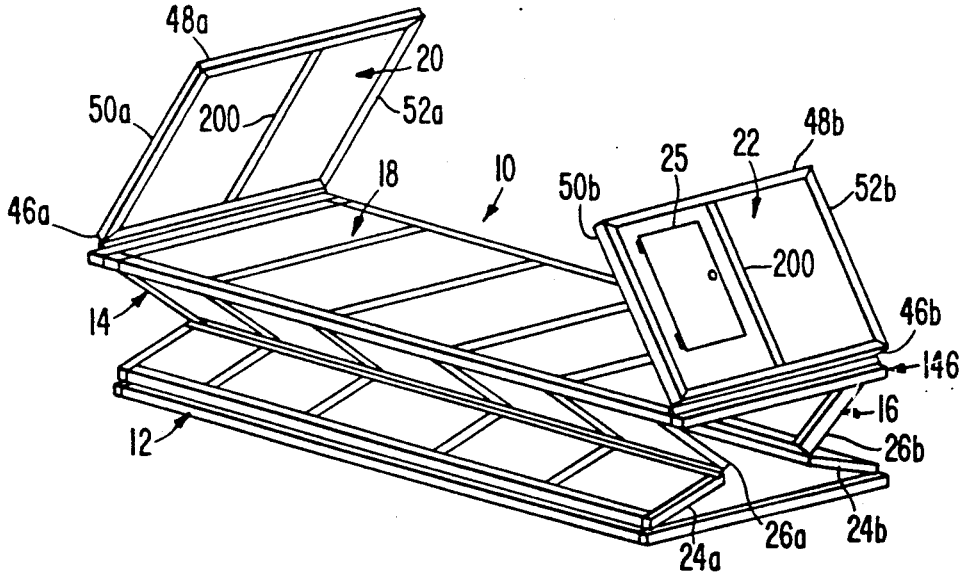
FIG. 2 is a left perspective view of the building structure of FIG. 1 in its partially collapsed position with hinge details omitted.
Figure 3:
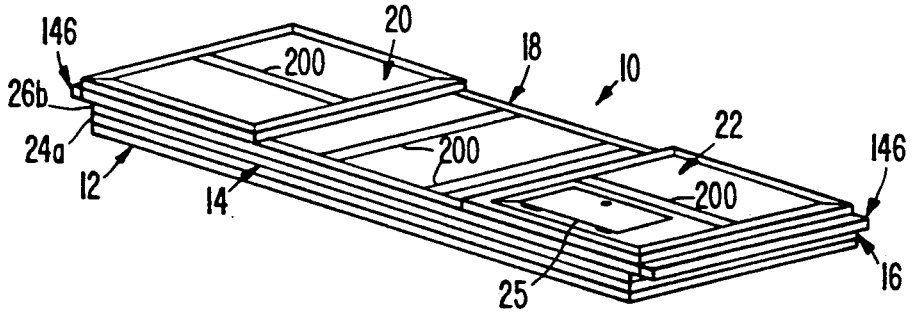
FIG. 3 is a left perspective view of the building structure of FIGS. 1 and 2 in its collapsed position with hinge details omitted.

Referring initially to FIGS. 1-3, the present invention relates to a building structure 10 that is readily and easily assembled and disassembled between a collapsed position and an erect position. The building structure 10 is shown in its erect position in FIG. 1, in its partially collapsed position in FIG. 2, and in its collapsed position in FIG. 3. The building structure 10 includes a floor 12, a first side wall 14, a second side wall 16, a roof 18, a first end wall 20 and a second end wall 22. Floor 12, side walls 14 and 16, roof 18, and end walls 20 and 22 are all substantially planar and rigid, and preferably made of a closed cell urethane foam insulation sandwiched between a pair of thin hard plastic skins. Thus, floor 12 and roof 18 constitute a first pair of opposed walls, first side wall 14 and second side wall 16 constitute a second pair of opposed walls, and first end wall 20 and second end wall 22 constitute a third pair of opposed walls forming a generally box-like, or parallelopiped, building structure 10.

A door 25 is pivotally mounted in second end wall 22 for access to the inside of building structure 10. It will be apparent to those skilled in the art that door 25 may be formed in any desired wall, and windows, other openings and the like may be added to the building structure 10 as desired.

Turning to FIGS. 4-8, the building structure 10 is shown in slightly more detail to illustrate generally how the building structure 10 is constructed and moved between erect positions and collapsed positions.

Figure 4:
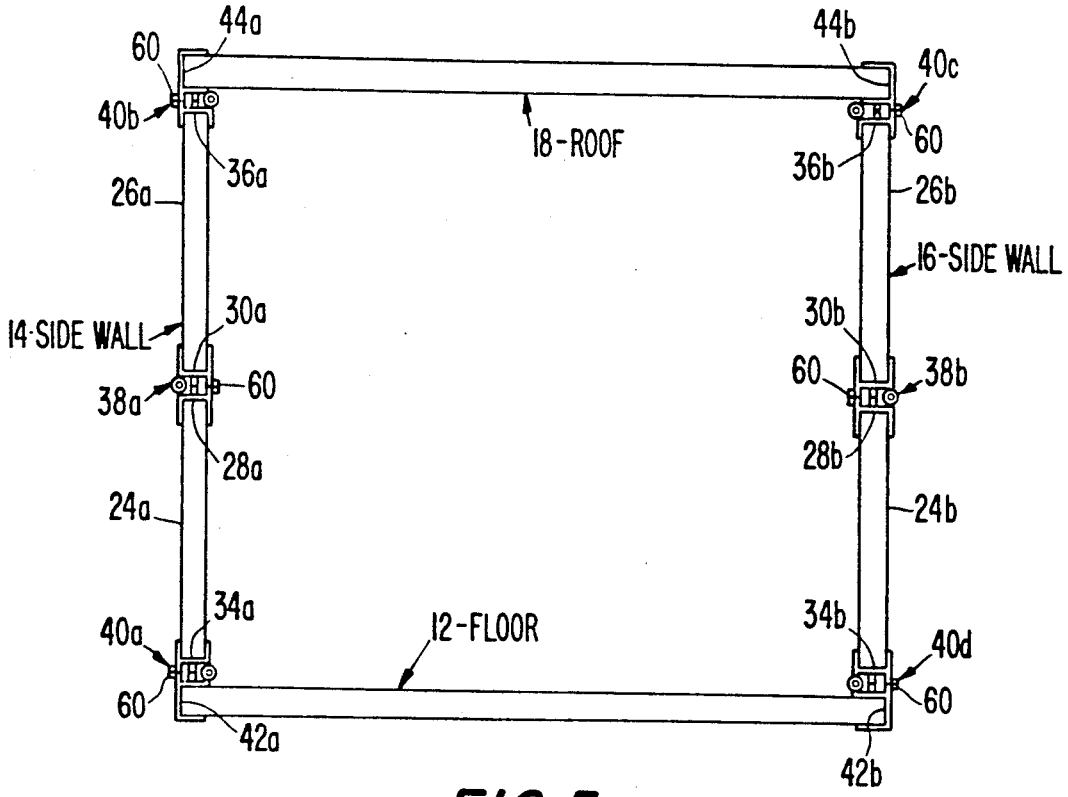
FIG. 4 is an end elevational view of the building structure of FIG. 1 in its erect position with its end walls removed and its hinge assemblies shown diagrammatically.
Figure 5:
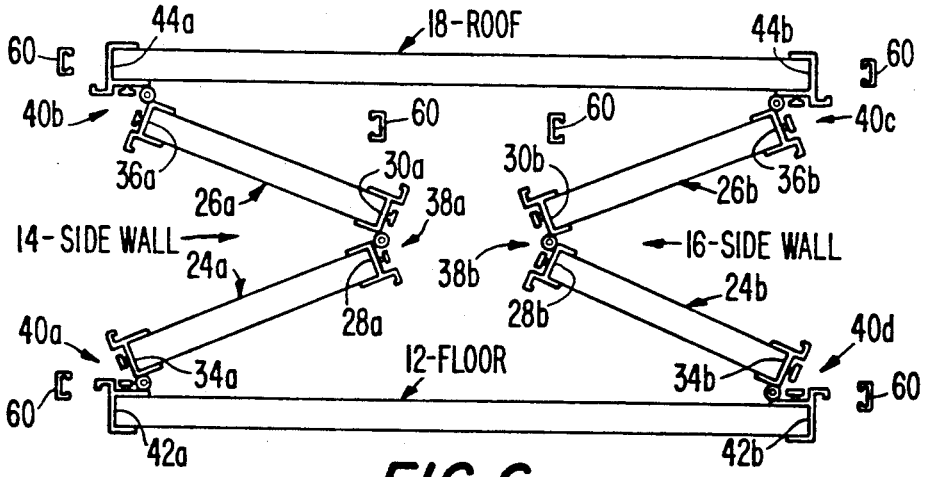
FIG. 5 is an end elevational view of the building structure of FIG. 4 in its partially collapsed position with its end walls removed and its hinge assemblies shown diagrammatically.
Figure 6:
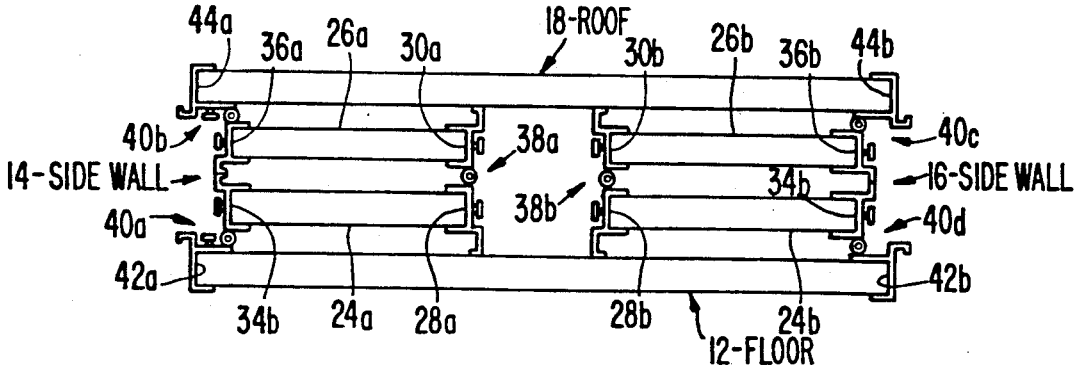
FIG. 6 is an end elevational view of the building structure of FIG. 5 in its collapsed position with its end walls removed and its hinge assemblies shown diagrammatically.

As seen in FIGS. 4-6, the first side wall 14 includes a first lower panel 24*a* and a first upper panel 26*a* having inner edges 28*a* and 30*a* and outer edges 34*a* and 36*a*, respectively. First lower panel 24*a* and first upper panel 26*a* are substantially the same size. The first lower panel 24*a* and the first upper panel 26*a* are pivotally coupled together at their inner edges 28*a* and 30*a* by a first hinge assembly 38*a*, which will be discussed in detail below. Outer edge 34*a* of the first lower panel 24*a* is pivotally coupled to floor 12, at its first side edge 42*a*, by second hinge assembly 40*a*. Outer edge 36*a* of the first upper panel 26*a* is pivotally coupled to roof 18 at its first side edge 44*a* by second hinge assembly 40*b*, which will be discussed in detail below.

The first hinge assembly 38*a* permits the first lower panel 24*a* and the first upper panel 26*a* to pivot 180° relative to one another so that they overlie each other as seen in FIG. 6.

The second hinge assemblies 40*a* and 40*b* permit the first lower panel 24*a* and the first upper panel 26*a* to pivot 90° with respect to floor 12 and roof 18. Thus, first lower panel 24*a* and first upper panel 26*a* lie substantially flat, adjacent the interior surfaces of floor 12 and roof 18 when in their collapsed positions, as seen in FIG. 6.

The second side wall 16 is the mirror image of first side wall 14; thus, second side wall 16 will only be discussed briefly. The second side wall 16 includes a second lower panel 24*b* and a second upper panel 26*b* having inner edges 28*b* and 30*b* and outer edges 34*b* and 36*b*, respectively. The second lower panel 24*b* and the second upper panel 26*b* are pivotally coupled together at their inner edges 28*b* and 30*b* by a first hinge assembly 38*b*, which will be discussed in detail below. Outer edge 34*b* is pivotally coupled to floor 12, at its second side edge 42*b*, by second hinge assembly 40*d*. Outer edge 36*b* is pivotally coupled to roof 18, at its second side edge 44*b*, by second hinge assembly 40*c*. Thus, second side wall 16 pivots in the same manner as first side wall 14, discussed above.

Figure 7:
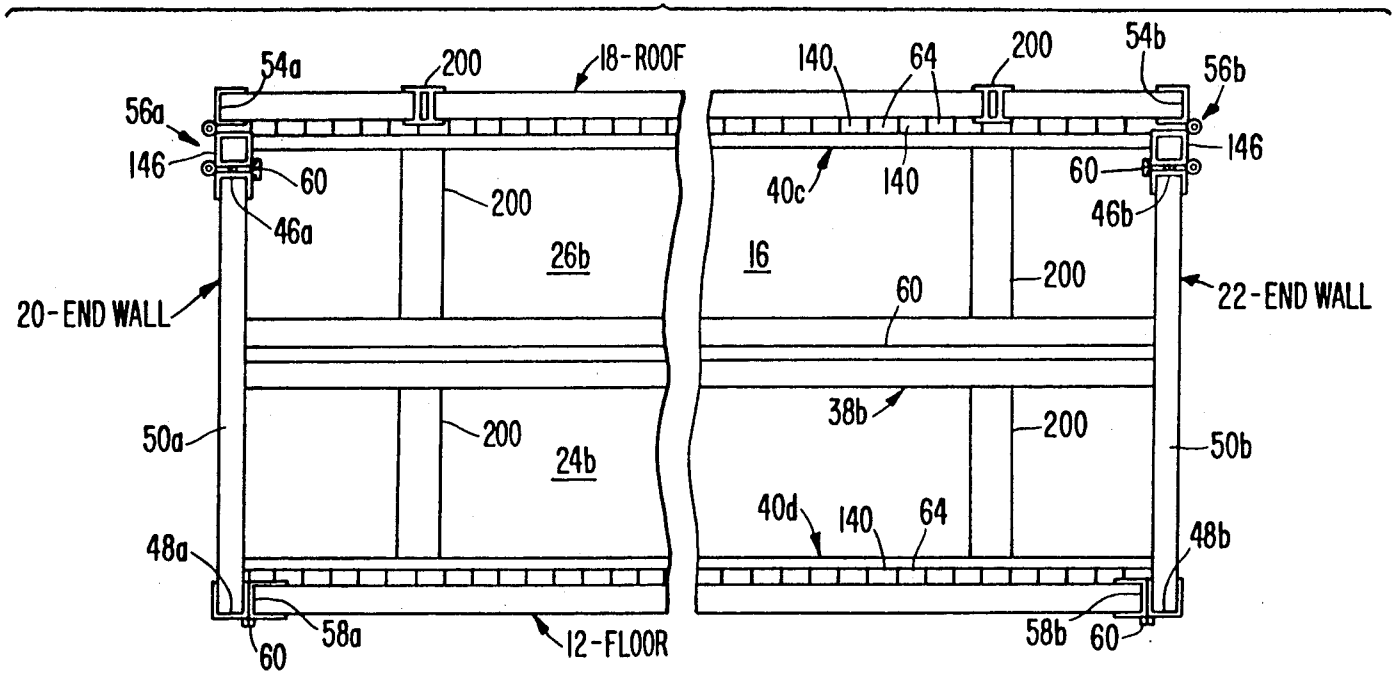
FIG. 7 is a side elevational view of the building structure of FIG. 1 shown in its erect position with one of its side walls removed and its hinge assemblies shown diagrammatically.
Figure 8:
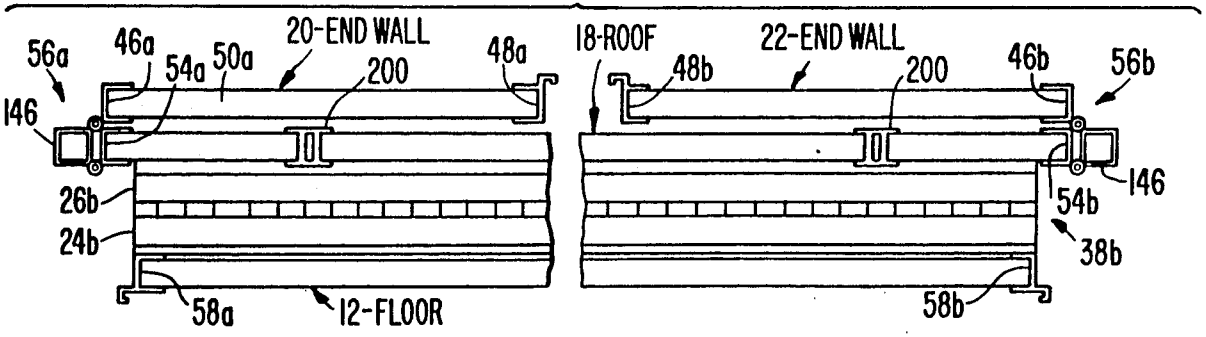
FIG. 8 is a side elevational view of the building structure of FIG. 7 shown in its collapsed position with one of its side walls removed and its hinge assemblies shown diagrammatically.

As seen in FIGS. 7 and 8, first and second end walls 20 and 22 are pivotally coupled to roof 18 and releasably coupled to floor 12. The first end wall 20 has an upper edge 46*a*, a lower edge 48*a*, a first vertical edge 50*a* and a second vertical edge 52*a*, as particularly shown in FIG. 2. The upper edge 46*a* is pivotally connected to roof 18, at its first end edge 54*a*, by a third hinge assembly 56*a*. The lower edge 48*a* is releasably coupled to floor 12 at its first end edge 58*a* by an elongated coupling clip 60, which will be discussed in more detail below.

As seen in FIG. 8, the third hinge assembly 56*a* permits the first end wall 20 to pivot 270° from a vertical position to a horizontal position in which the first end wall 20 lies substantially flat upon roof 18.

The second end wall 22 is the mirror image of the first end wall 20; thus, the second end wall 22 will only be discussed briefly. The second end wall 22 includes an upper edge 46*b*, a lower edge 48*b*, a first vertical edge 50*b* and a second vertical edge 52*b*, as seen in FIG. 2. The upper edge 46*b* is pivotally coupled to roof 18, at its second end edge 54*b*, by a third hinge assembly 56*b*, which will be discussed in more detail below. The lower edge 48*b* is releasably coupled to floor 12, at its second end edge 58*b*, by a coupling clip 60, which will be discussed in more detail below.

Figure 9:
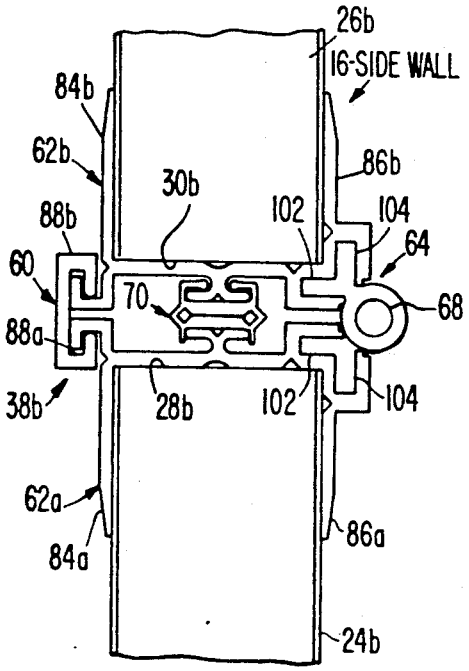
FIG. 9 is an enlarged, fragmentary, end elevational view of a side wall of the building structure with its lower and upper panels pivotally coupled together by a first hinge assembly shown in its locked position.
Figure 10:
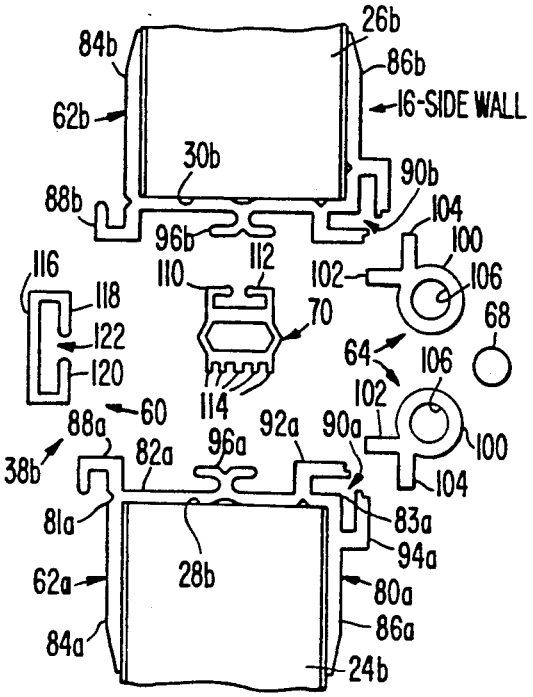
FIG. 10 is an enlarged, fragmentary, exploded end elevational view of the first hinge assembly shown in FIG. 9.

Referring now to FIGS. 9 and 10, first hinge assembly 38*b* is shown in more detail. Since first hinge assemblies 38*a* and 38*b* are mirror images of each other, only first hinge assembly 38*b* will be discussed in detail below.

First hinge assembly 38*b* includes a pair of first coupling channels 62*a* and 62*b*, a plurality of hinge inserts 64, a hinge pin 68, a first sealing member 70 and a coupling clip 60. The first coupling channels 62*a* and 62*b* are identical extrusions, thus only coupling channel 62*a* will be discussed in detail.

First coupling channel 62*a* is a one-piece integrally formed channel made preferably from plastic. Also, first coupling channel 62*a* is preferably extruded, having a generally U-shaped transverse cross section.

The first coupling channel 62*a* includes a base 80*a* having a generally planar central portion 82*a* with integrally formed first and second legs 84*a* and 86*a* extending substantially perpendicular thereto. Extending outwardly from the base 80*a* at a first corner 81*a* formed by first leg 84*a* and central portion 82*a* is an L-shaped locking member or flange 88*a*. Locking flange 88*a* preferably extends along the entire length of first coupling channel 62*a* and opens in the same direction as channel 62*a*.

At the second corner 83*a* formed by second leg 86*a* and central portion 82*a* is a V-shaped retaining groove 90*a* formed by a pair of L-shaped guide flanges 92*a* and 94*a* that extend along the longitudinal length of the first coupling channel 62*a*. The guide flange 92*a* extends outwardly from central portion 80*a* with its free end extending towards the second corner 83*a*. The guide flange 94*a* extends outwardly from the second leg 84*a* with its free end extending towards the second corner 83*a*.

The central portion 82*a* has a T-shaped rib 96*a* extending outwardly midway between first and second corners 81*a* and 83*a* and along the entire length of first coupling channel 62*a*.

Figure 13:
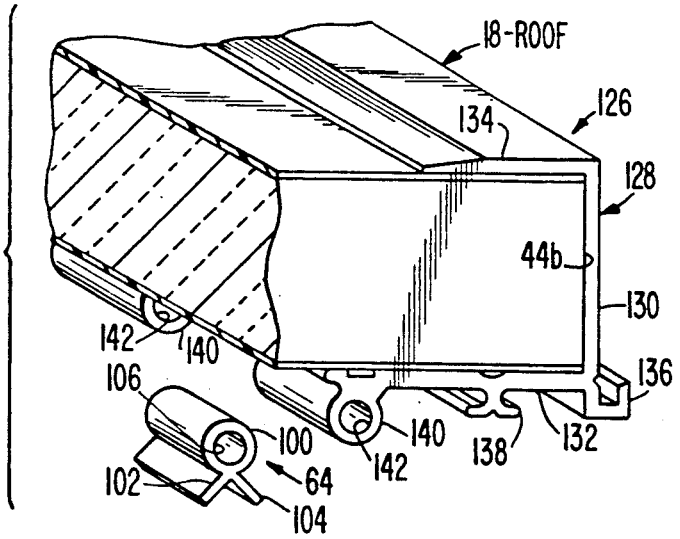
FIG. 13 is an enlarged, fragmentary, left perspective view of a second coupling channel and a hinge insert for the second hinge assembly shown in FIGS. 11-12.

Hinge inserts 64 are preferably formed of extruded plastic and include a tubular portion 100 and a pair of arms 102 and 104, particularly shown in FIG. 13. The tubular portion 100 has a cylindrical bore 106 which is sized to receive hinge pin 68 therein. The arms 102 and 104 extend outwardly from the periphery of tubular portion 100 and along its longitudinal length. The arms 102 and 104 form a V-shaped flange with an angle of about 90° therebetween. The arms 102 and 104 are sized to be slidably received in the V-shaped retaining groove 90*a* so that they may be frictionally retained therein. The friction fit therebetween may be accomplished by making the angle between the arms 102 and 104 about 88° and the slots of the retaining groove 90*a* about 90° apart, or by making the arms 102 and 104 slightly larger than the width of the retaining groove 90*a*.

The hinge pin 68 is preferably an elongated cylindrical metal rod.

The first sealing member 70 is substantially hexagonal in shape with a pair of L-shaped arms 110 and 112 extending outwardly from one of its sides and five ribs 114 extending outwardly from an opposite side thereof. The sealing member 70 is preferably formed of soft, resilient rubber, such as a thermoplastic rubber or a flexible polymer extrusion. Arms 110 and 112 are spaced apart for gripping the T-shaped rib 96*b* of the first coupling channel 62*b* as seen in FIG. 10.

The coupling clip 60 is generally C-shaped with a generally planar central portion 116 having a pair of L-shaped legs 118 and 120 extending outwardly therefrom and forming a rectangular slot 122. The slot 122 is sized to slidably receive locking flanges 88*a* and 88*b* of each first coupling channel 62*a* and 62*b* therein for locking first coupling channels 62*a* and 62*b* together as seen in FIG. 9. The coupling clip 60 is preferably formed of extruded plastic.

Accordingly, first hinge assembly 38*b* is assembled by attaching first coupling channel 62*a* along inner edge 28*b* of second lower panel 24*b* and first coupling channel 62*b* along inner edge 30*b* of second upper panel 26*b*. This is preferably accomplished by applying adhesive to the inner faces of the legs 84*a* and 86*a* and the inner faces of legs 84*b* and 86*b* of the coupling channels 62*a* and 62*b*, respectively. The hinge inserts 64 are then coupled to each first coupling channel 62*a* and 62*b* by sliding arms 102 and 104 of hinge inserts 64 into retaining grooves 90*a* and 90*b* of first coupling channels 62*a* and 62*b*. The hinge inserts 64 should be spaced apart from each other in retaining grooves 90*a* and 90*b* so that the hinge inserts 64 alternate between first coupling channels 62*a* and 62*b*. Thus, hinge pin 68 is then inserted into bores 106 of hinge inserts 64 to pivotally couple first coupling channels 62*a* and 62*b* together.

To lock second lower panel 24*b* and second upper panel 26*b* in their erect position shown in FIG. 9, coupling clip 60 is slid over locking flanges 88*a* and 88*b* of first coupling channels 62*a* and 62*b*, respectively.

Figure 11:
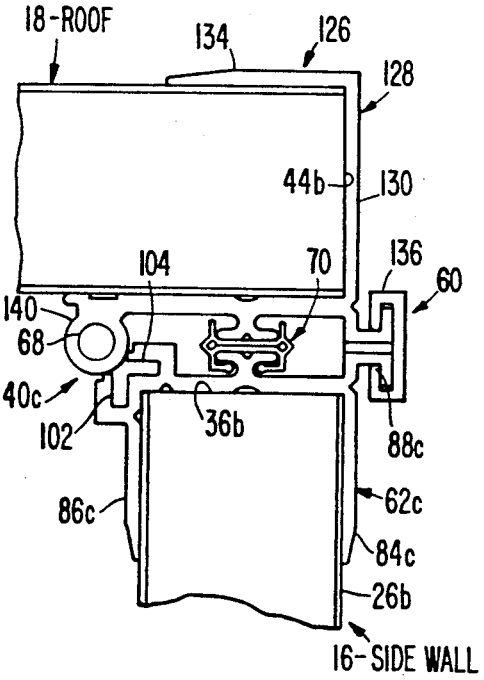
FIG. 11 is an enlarged, fragmentary, end elevational view of a side wall of the building structure pivotally coupled to the roof by a second hinge assembly shown in its locked position in accordance with the present invention.
Figure 12:
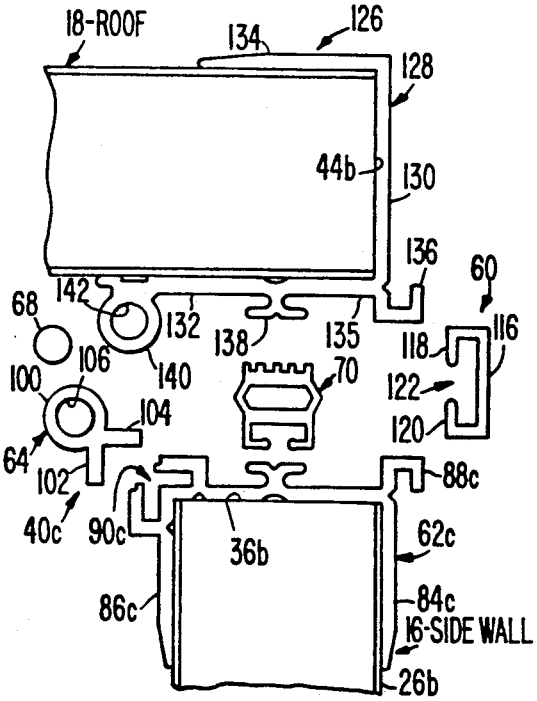
FIG. 12 is an enlarged, fragmentary, exploded end elevational view of the second hinge assembly shown in FIG. 11.

Referring now to FIGS. 11–13, a second hinge assembly 40*c* is shown in more detail. Since all the second hinge assemblies 40*a*, 40*b*, 40*c* and 40*d* are substantially identical to one another, only hinge assembly 40*c* will be discussed in detail below.

Hinge assembly 40*c* includes a first coupling channel 62*c*, a second coupling channel 126, a plurality of hinge inserts 64 (discussed above), a hinge pin 68 (discussed above), a first sealing member 70 (discussed above) and a coupling clip 60 (discussed above).

First coupling channel 62*c* is identical to the first coupling channel 62*b* discussed above, and thus will not be discussed in detail.

Second coupling channel 126 is a one-piece integrally formed channel made preferably from plastic. Also, second coupling channel 126 is preferably extruded.

As seen in FIG. 13, second coupling channel 126 includes a base 128 having a generally U-shaped transverse cross section along its longitudinal length. The base 128 includes a generally planar central portion 130 with integrally formed first and second legs 132 and 134 extending substantially perpendicular thereto. At the first corner 135 formed by first leg 132 and central portion 130 is an L-shaped locking flange or member 136 that extends outwardly along the longitudinal length of second coupling channel 126. Substantially midway along the second leg 132 is a T-shaped rib 138 which extends outwardly along the longitudinal length of second coupling channel 126. At the free end of first leg 132 is a plurality of spaced hinge portions 140. The hinge portions 140 are spaced longitudinally along the first leg 132 for receiving hinge inserts 64 between adjacent hinge portions 140. Each hinge portion 140 has a bore 142 extending axially therethrough for receiving a hinge pin 68.

Accordingly, second hinge assembly 40*c* is assembled by attaching first coupling channel 62*c* along outer edge 36*b* of second upper panel 26*b* and second coupling channel 126 along second side edge 44*b* of roof 18. This is preferably accomplished by applying adhesive to the inner faces of the legs 84*c* and 86*c* and the inner faces of the legs 132 and 134 of the coupling channels 62*c* and 126, respectively. The hinge inserts 64 are then coupled to first coupling channel 62*c* by sliding arms 102 and 104 of hinge inserts 64 into retaining groove 90*c*. The hinge inserts 64 should be spaced apart from each other in retaining groove 90*c* to receive hinge portions 140 between adjacent hinge inserts 64. Hinge pin 68 is then inserted into bores 106 of the hinge inserts 64 and bores 142 of hinge portions 140 to pivotally couple first coupling channels 62*c* / *126 together.*

To lock roof 18 and second upper panel 26*b* in their erect position, coupling clip 60 is slide over locking flanges 88*c* and 136 of first and second coupling channels 62*c* and 126, respectively.

Figure 14:
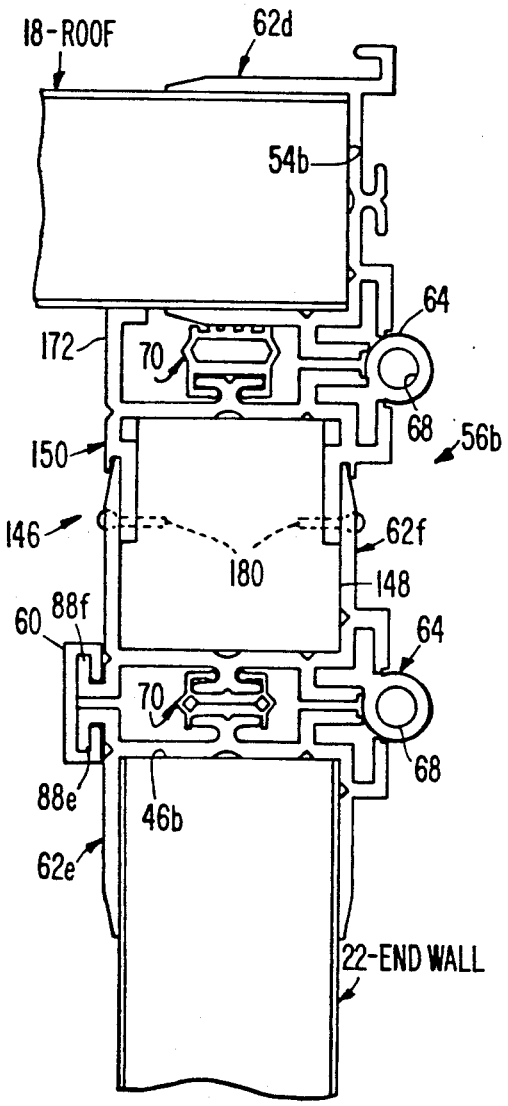
FIG. 14 is an enlarged, fragmentary, side elevational view of an end wall of the building structure pivotally coupled to the roof by a third hinge assembly shown in its locked position in accordance with the present invention.
Figure 15:
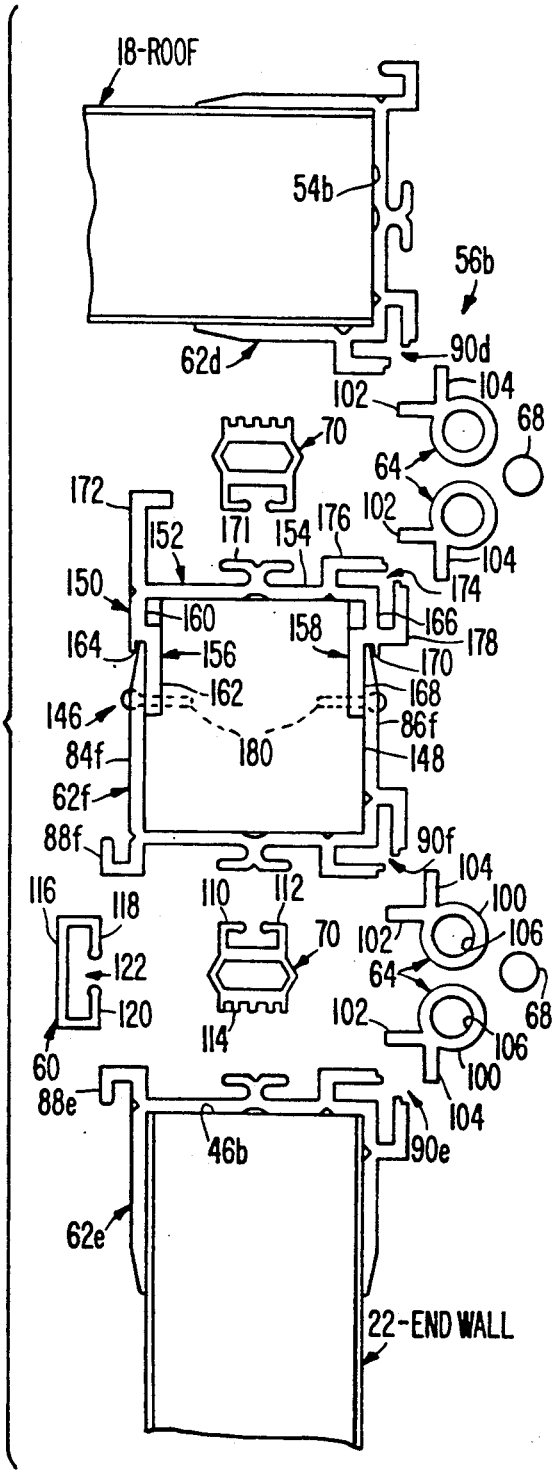
FIG. 15 is an enlarged, fragmentary, exploded side elevational view of the third hinge assembly shown in FIG. 14.

Referring now to FIGS. 14 and 15, third hinge assembly 56*b* is shown in more detail. Since third hinge assemblies 56*a* and 56*b* are mirror images of one another, only third hinge assembly 56*b* will be discussed in detail below.

Third hinge assembly 56*b* includes a pair of first coupling channels 62*d* and 62*e*, a header member 146, a plurality of hinge inserts 64 (discussed above), a pair of first sealing members 70, a coupling clip 60, and pair of hinge pins 68. The first coupling channels 62*d* and 62*e* will not be discussed in detail since they are substantially identical to coupling channel 62*b*, discussed above.

The header member 146 includes a block member 148, a first coupling channel 62*f* and third coupling channel 150. The first coupling channel 62*f* will not be discussed in detail since it is substantially identical to coupling channel 62*b*, discussed above.

Block member 148 is preferably an elongated wooden block for supporting and engaging first coupling channel 62*f* and third coupling channel 150.

Third coupling channel 150 is a one-piece integrally formed channel made preferably from plastic. Also, third coupling channel 150 is preferably extruded.

The third coupling channel 150 has a base 152 with a generally U-shaped cross section along its longitudinal axis. The base 152 has a generally planar central portion 154 with first and second legs 156 and 158 extending substantially perpendicular thereto.

The first leg 156 includes a first planar portion 160, a second planar portion 162 and a leg retaining recess 164. The first planar portion 160 extends from central portion 154. The second portion 162 is offset from the first portion 160 to form recess 164 for receiving leg 84*f* of first coupling channel 62*f*.

Second leg 158 is substantially the mirror image of first leg 156, thus, it will be discussed only briefly. The second leg 158 includes first and second planar portions 166 and 168 with a recess 170 formed therebetween for receiving leg 86*f* of a first coupling channel 62*f*.

The central portion 154 includes a T-shaped rib 171 extending outwardly along its longitudinal axis and midway between its ends. At the corner formed by the first leg 156 and the central portion 154 is an L-shaped stop member 172 extending perpendicularly to the central portion 154.

At the corner formed by the second leg 158 and the central portion 154 is a V-shaped retaining groove 174. The V-shaped groove 174 is formed by a pair of L-shaped guide flanges 176 and 178. The L-shaped guide flange 176 extends outwardly from the central portion 154 while the L-shaped guide flange 178 extends outwardly from the second leg 158.

Accordingly, third hinge assembly 56*b* is assembled by attaching first coupling channel 62*d* along second end edge 54*b* of roof 18 and first coupling channel 62*e* along upper edge 46*b* of second end wall 22. This is preferably accomplished by applying adhesive to the inner faces of the legs of the coupling channels.

The header member 146 is assembled by surrounding block member 148 with first coupling channel 62*f* and third coupling channel 150 so that legs 84*f* and 86*f* are received in recesses 164 and 170, respectively. Assembly of header block 146 is preferably accomplished by applying adhesive to the inner faces of the legs 84*f* and 86*f* of the coupling channel 62*f* and the inner faces of the legs 156 and 158 of the coupling channel 150. Screws 180 also may be used to secure header member 146 together.

Now, a plurality of hinge inserts 64 are coupled to each first coupling channel 62*d*, 62*e* and 62*f* and third coupling channel 150 by sliding the arms 102 and 104 of the hinge inserts 64 into retaining grooves 90*d*, 90*e*, 90*f* and 174. The hinge inserts 64 in each channel should be spaced apart from each other so that hinge inserts 64 of adjacent channels will alternate between each other. Hinge pins 68 are then inserted into bores 106 of hinge inserts 64 to pivotally couple header member 146 to both of the first coupling channels 62*d* and 62*e* as seen in FIG. 14.

To lock header member 146 and second end wall 22 together, coupling clip 60 is slid over locking flanges 88*e* and 88*f* of first coupling channels 62*e* and 62*f*, respectively as seen in FIG. 14.

Figure 16:
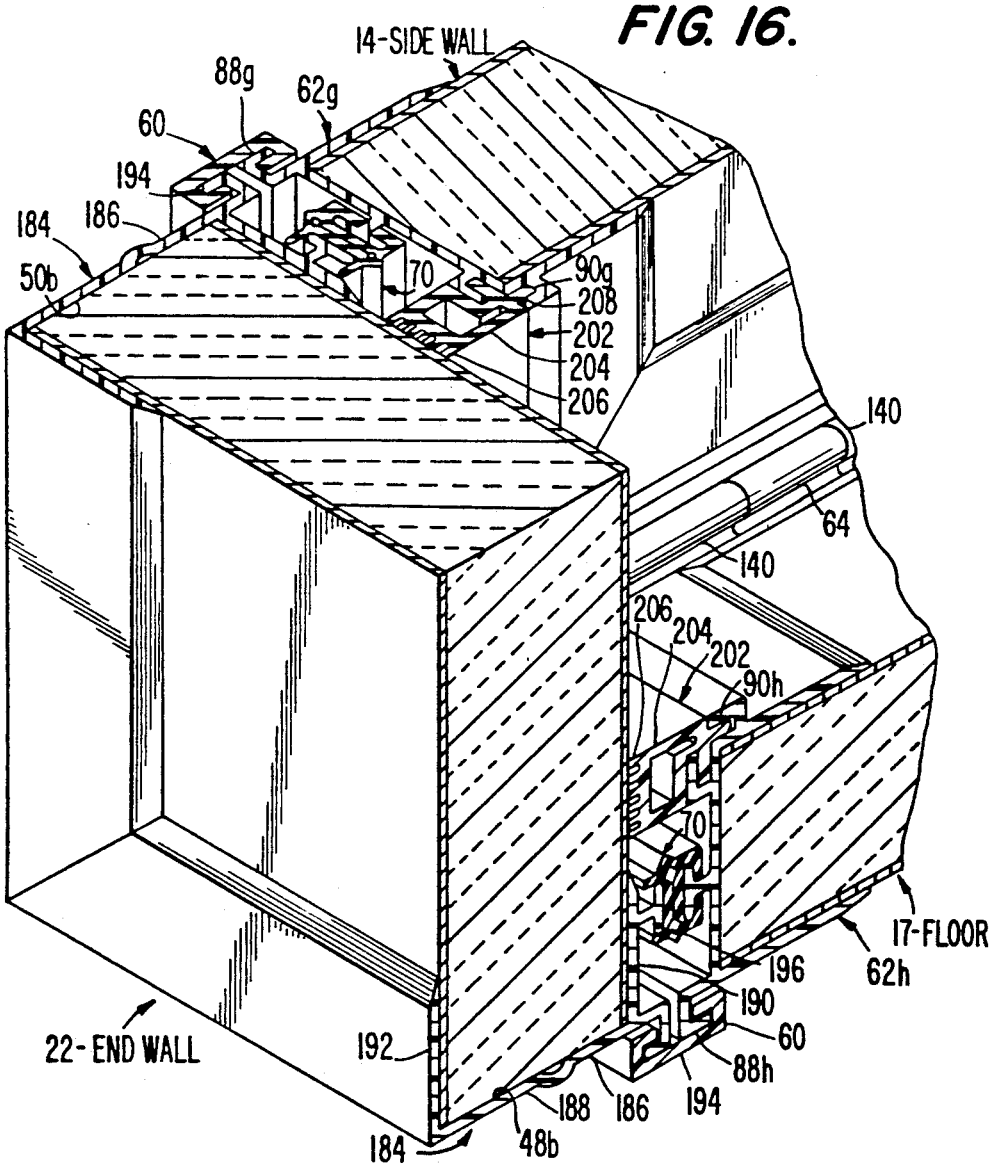
FIG. 16 is an enlarged, right perspective view of one of the end walls coupled to the floor and to one of the side walls of the building structure in accordance with the present invention.

Referring now to FIG. 16, end wall 22 is shown coupled to the first side wall 14 and the floor 12 by coupling clips 60. The second end wall 22 has a fourth coupling channel 184 secured along both of its first and second vertical edges 50*b* and 52*b* as well as its lower edge 48*b* (only first vertical edge 50*b* and lower edge 48*b* are shown).

Each of the fourth coupling channels 184 has a base 186 with a generally U-shaped transverse cross section. The base 186 includes a generally planar central portion 188 having a first and second leg 190 and 192 extending perpendicularly thereto. At the corner formed by the central portion 188 and the first leg 190 is an L-shaped locking flange or member 194 for receiving a C-shaped coupling clip 60. The first leg 190 also has a T-shaped rib 196 extending outwardly along its longitudinal length for engaging a sealing member 70.

Each of the fourth coupling channels 184 is a one-piece integrally formed channel made preferably from plastic. Also preferably, fourth coupling channels 184 are manufactured by extruding the plastic.

Assembly of the coupling channels 184 to the end walls 20 and 22 along their lower edges 48*a* and 48*b*, and their vertical edges 50*a*, 52*a*, 50*b* and 52*b*, respectively, the preferably accomplished by applying adhesive to the inner faces of legs 190 and 192 of the coupling channels 184.

A second sealing member 202 is inserted into each of the retaining grooves 90*g* and 90*h* of first coupling channels 62*g* and 62*h*. Second sealing members 202 have a body portion 204, a plurality of ribs 206, and a V-shaped connecting flange 208. The V-shaped connecting flanges 208 of second sealing members 202 are slidably received in retaining grooves 90*g* and 90*h*, while their ribs 206 extend outwardly from their body portions 204 to engage end wall 22 for sealing the end of the building structure 10.

To lock end wall 22 to side walls 14 and 16 and floor 12, coupling clips 60 are slid over locking flanges 194 of the fourth coupling channels 184 and the adjacent locking flanges (only locking flanges 88*g* and 88*h* are shown) of the first coupling channels (only channels 62*g* and 62*h* are shown) as seen in FIG. 16.

The other end wall 20 is releasably coupled to the first side wall 14, the second side wall 16 and the floor 12 by coupling clips 60 in the same manner as end wall 22, discussed above.

An L-shaped corner member may be coupled at the corners of the end walls 20 and 22 for additional strength. These L-shaped corner members are preferably made of a lightweight metal, such as aluminum. A portion of the foam insulation of the end walls 20 and 22 may be removed at each corner for accommodating a corner member therein. The corner members are coupled to the base of adjacent coupling channels by a pair of pop rivets in each of the bases. The pop rivets are preferably made of aluminum.

To erect the building structure 10 from its collapsed position, as seen in FIGS. 3, 6 and 8, two people, one at each end, will lift the roof 18 until side walls 14 and 16 are generally straight. A person then slides an elongated coupling clip 60 over the locking flanges of first hinge assemblies 38*a* and 38*b*, and second hinge assemblies 40*a*, 40*c* and 40*d*, as discussed above. The end walls 20 and 22 now may be rotated 270°, and coupled to the side walls 14 and 16 and floor 12 by sliding coupling clips 60 over their respective locking flanges 194, 88*g* and 88*h*, as discussed above. At this time, header members 146 may be locked to side walls 20 and 22 via coupling clips 60 on locking flanges 88*e* and 88*f*, as discussed above.

Alternatively, the building structure 10 may be erected with only two people from its collapsed position, as seen in FIGS. 3, 6 and 8, by erecting one of the side walls 14 and 16 at a time. The two people, one at each end of the roof 18, will lift the roof 18 at side edge 44*a* until side wall 14 is generally straight. This will cause the roof 18 to pivot from the collapsed side wall 16, at the hinge 40*c*, while upper and lower side walls 26*a* and 24*a* of the side wall assembly 14 will unfold and align vertically to one another. A person then slides an elongated coupling clip 60 over the locking flanges of first hinge assembly 38*a*, as shown above in FIG. 9. The two people then move to side edge 44*b* of the roof 18, with one person at each end of the roof 18. They will lift the roof 18 upwardly at side edge side wall 14. With the roof 18 and side walls 14 and 16 now 44*b* until side wall 16 is generally straight. A person then slides an elongated coupling clip 60 over the locking flanges of first hinge assembly 38*b* as discussed above for side wall 14. With the roof 18 and side walls 14 and 16 now raised, and with all second hinge assemblies 40*a*, 40*b*, 40*c* and 40*d* in their erect positions, a person then slides an elongated coupling clip 60 over the locking flanges of each second hinge assembly as shown in FIG. 4 and FIG. 11. The end walls 20 and 22 now may be rotated 270° downward by third hinge assemblies 56*a* and 56*b*, as seen in FIG. 7 and FIG. 8. Before the end walls 20 and 22 are coupled to the side walls 14 and 16 and floor 12, a person slides a coupling clip 60 over the respective mating flanges 88*e* and 88*f* of the header 146 and coupling channel 62*e* as shown in FIG. 14 and FIG. 15. The end walls 20 and 22 are then coupled to the side walls 14 and 16 and floor 12 by sliding coupling clips 60 over their respective locking flanges 194, 88*g* and 88*h* as seen in FIG. 16 and as discussed It will be apparent to those skilled in the art that the floor 12, side walls 14 and 16, roof 18 and end walls 20 and 22 may be constructed of several panels connected together by an H-shaped connecting channel 200 as seen in FIG. 7. The connecting channel 200 may be adhesively attached to adjacent panels.

If long panels are used, then the connecting channels 200 may require additional support to resist external deflective loads or forces that a shorter panel would not require. In such applications, the connecting channel 200 preferably includes a centrally located hollow rectangular cavity, sized to accommodate a metal reinforcement member or insert longitudinally disposed therein so as to stiffen the extruded plastic portions of connecting channel 200.

While only one embodiment has been chosen to illustrate the invention, it will be understood by those skilled in the art that various changes and modifications can be made herein with out departing from the scope of the invention as defined in the appended claims.

What is claimed is:

1. A portable and collapsible building structure, comprising:

a first pair of opposed walls;

a second pair of opposed walls, each of said second pair of walls including first and second panels pivotally coupled together by first hinge means, each of said second pair of walls being pivotally coupled to each of said first pair of walls by second hinge means, whereby said second pair of walls may be collapsed inwardly from erect positions to collapsed positions such that each of said first panels overlies one of said second panels;

a third pair of opposed walls, each of said third pair of walls being pivotally coupled to one o said first pair of walls by third hinge means, each of said third hinge means including a header having a first hinge member and second hinge member spaced apart from said first hinge member, said first hinge member pivotally coupling said header to one of said first pair of walls, and said second hinge member pivotally coupling said header to one of said third pair of walls such that said headers permit each of said third pair of walls to pivot about 270° between collapsed positions in which said third pair of walls lie substantially parallel to said first pair of walls and erect positions in which said third pair of walls and said headers lie substantially perpendicular to said first pair of walls; and coupling means, coupled to said first, second and third pairs of walls, for retaining said first, second and third pairs of walls in their erect positions.

2. A portable and collapsible building structure according to claim 1, wherein said first hinge means comprises means for pivotally coupling said first and second panels of each of said second pair of walls about 180°, relative to each other, between their collapsed and erect positions.

3. A portable and collapsible building structure according to claim 1, wherein said second hinge means comprises means for pivotally coupling said first and second panels of each of said second pair of walls about 90°, relative to said first pair of walls, between their collapsed and erect positions.

4. A portable and collapsible building structure according to claim 1, wherein each of said third pair of walls has one end pivotally coupled to one of said first pair of walls by said third hinge means and its opposite end releasably coupled to the other of said first pair of walls by said coupling means for retaining said third pair of walls in their erect positions.

5. A portable and collapsible building structure according to claim 1, wherein said third pair of walls are releasably coupled to said second pair of walls by said coupling means for retaining said third pair of walls in their erect positions.

6. A portable and collapsible building structure according to claim 1, wherein said first, second and third pairs of walls are all substantially planar.

7. A portable and collapsible building structure according to claim 1, wherein said first, second and third pairs of walls are all substantially rigid.

8. A portable and collapsible building structure according to claim 1, wherein each of said first, second and third hinge means includes sealing means.

9. A portable and collapsible building structure according to claim 1, wherein said first and second panels are substantially equal in size.

10. A portable and collapsible building structure, comprising:

a first pair of opposed walls;

a second pair of opposed walls, each of said second pair of walls including first and second panels pivotally coupled together by first hinge means, said second pair of walls being pivotally coupled to said first pair of walls by second hinge means, said first and second hinge means being pivotable such that said second walls may be moved between collapsed positions and erect positions;

a third pair of opposed walls, each of said third pair of walls being pivotally coupled to one of said first pair of walls by third hinge means for pivoting about 270°, relative to said one of said first pair of walls, between collapsed and erect positions, each of said third hinge means including a header having a first hinge member and a second hinge member spaced apart from said first hinge member, said first hinge member pivotally coupling said header to one of said first pair of walls, and said second hinge member pivotally coupling said header to one of said third pair of walls; and coupling means, coupled to said first, second and third pairs of walls, for retaining said first, second and third pairs of wall in their erect positions.

11. A portable and collapsible building structure according to claim 10, wherein said first hinge means comprises means for pivotally coupling said first and second panels of each of said second pair of walls about 180°, relative to each other, between their collapsed and erect positions.

12. A portable and collapsible building structure according to claim 10, wherein said second hinge means comprises means for pivotally coupling said first and second panels of each of said second pair of walls about 90°, relative to said first pair of walls, between their collapsed and erect positions.

13. A portable and collapsible building structure according to claim 10, wherein each of said third pair of walls has one end pivotally coupled to one of said first pair of walls by said third hinge means and its opposite end releasably coupled to the other of said first pair of walls by said coupling means for retaining said third pair of walls in their erect positions.

14. A portable and collapsible building structure according to claim 10, wherein said third pair of walls are releasably coupled to said second pair of walls by said coupling means for retaining said third pair of walls in their erect positions.

15. A portable and collapsible building structure according to claim 10, wherein said first, second and third pairs of walls are all substantially planar and substantially rigid.

16. A portable and collapsible building structure according to claim 10, wherein each of said first, second and third hinge means includes sealing means.

17. A portable and collapsible building structure, comprising:

a floor having first and second side edges, and first and second end edges;

a first side wall, including a first lower panel and a first upper panel, said first lower and upper panels each having an outer edge, an inner edge, a first vertical edge and a second vertical edge;

a second side wall, including a second lower panel and a second upper panel, said second lower and upper panels each having an outer edge, an inner edge, a first vertical edge and a second vertical edge;

a roof having first and second side edges, and first and second end edges;

first and second end walls, each having upper and lower edges, and first and second vertical edges;

a pair of first hinge means, one coupled to said inner edges of said first lower panel and said first upper panel and the other coupled to said inner edges of said second lower panel and said second upper panel, for pivotally coupling said first lower panel to said first upper panel and said second lower panel to said second upper panel between collapsed positions and erect positions;

two pairs of second hinge means for pivotally coupling said floor to said first and second side walls and said roof to said first and second side walls between collapsed positions and erect positions, one of said pairs of second hinge means coupling said first and second said edges of said floor to said outer edges of said first and second lower panels, respectively, and the other of said pairs of said second hinge means coupling said first and second side walls of said roof to said outer edges of said first and second upper panels, respectively;

a pair of third hinge means, one coupled to said first end edge of said roof and to said upper edge of said first end wall and the other coupled to said second end edge of said roof and to said upper edge of said second end wall, for pivotally coupling said first and second end walls to said roof for pivoting about 270°, relative to said roof, between collapsed positions and erect positions, each of said third hinge means including a header member having a first hinge member and a second hinge member spaced apart from said first hinge member, said first hinge members pivotally coupling said header members to said upper edges of said first and second end walls, respectively, and said second hinge members pivotally coupling said header members to said first and second end edges of said roof, respectively;

first coupling means, coupled to each of said first hinge means, for retaining said first lower and upper panels and said second lower and upper panels in their erect positions;

second coupling means, coupled to each of said second hinge means, for retaining said floor, said roof and said first and second side walls in their erect positions;

third coupling means, coupled to each of said third hinge means, for retaining said first and second end walls to their respective said header member; and fourth coupling means, coupled to each of said lower edges of said first and second end walls and said first and second end edges of said floor, for retaining said first and second end walls in their erect positions.

18. A portable and collapsible building structure according to claim 17, wherein said pair of first hinge means comprises means for pivotally coupling said first and second lower panels about 180°, relative to said first and second upper panels, between their collapsed and erect positions.

19. A portable and collapsible building structure according to claim 17, wherein said two pairs of second hinge means comprises means for pivotally coupling said first and second lower panels about 90°, relative to said floor, and said first and second upper panels about 90°, relative to said roof, between their collapsed and erect positions.

20. A portable and collapsible building structure according to claim 17, wherein said pair of third hinge means comprises means for pivotally coupling said first and second end walls about 270°, relative to said roof, between their collapsed and erect positions.

21. A portable and collapsible building structure according to claim 17, further comprising fifth coupling means, coupled to each of said first and second vertical edges of said first and second side walls and said first and second vertical edges of said first and second end walls, for retaining said first and second end walls in their erect positions.

* * * * *